US008480173B2

(12) United States Patent
Huang

(10) Patent No.: US 8,480,173 B2
(45) Date of Patent: Jul. 9, 2013

(54) AUXILIARY MOVING DEVICE

(76) Inventor: Miao-Yuan Huang, Xizhi (TW)

( * ) Notice: Subject to any disclaimer, the term of this patent is extended or adjusted under 35 U.S.C. 154(b) by 392 days.

(21) Appl. No.: 12/791,277

(22) Filed: Jun. 1, 2010

(65) Prior Publication Data

US 2011/0289679 A1 Dec. 1, 2011

(51) Int. Cl.
*A47C 1/00* (2006.01)

(52) U.S. Cl.
USPC ..... 297/344.22; 297/344.21; 297/344.26

(58) Field of Classification Search
USPC ..... 297/256.12, 344.28, 344.21, 344.22, 297/344.24, 440.24, 344.26
See application file for complete search history.

(56) References Cited

U.S. PATENT DOCUMENTS

| | | | | |
|---|---|---|---|---|
| 4,762,364 | A * | 8/1988 | Young | 297/256.12 |
| 5,740,563 | A * | 4/1998 | Gaddy | 4/579 |
| 5,822,809 | A * | 10/1998 | Gallo | 4/578.1 |
| 2007/0007808 | A1 * | 1/2007 | van Deursen | 297/344.21 |
| 2008/0265642 | A1 * | 10/2008 | Moyers | 297/344.21 |
| 2009/0025136 | A1 * | 1/2009 | Cheng | 4/560.1 |

* cited by examiner

*Primary Examiner* — David Dunn
*Assistant Examiner* — Timothy J Brindley
(74) *Attorney, Agent, or Firm* — Alan Kamrath; Kamrath IP Lawfirm, P.A.

(57) ABSTRACT

An auxiliary moving device contains a first cushion and a second cushion mounted on the first cushion. A rotating mechanism is retained between the first and second cushions, with the first cushion used to hold the second cushion by using the rotating mechanism. The second cushion rotates relative to the first cushion by ways of the rotating mechanism. A positioning mechanism is connected with the first and the second cushions, and second cushion is fixed on the first cushion by using the positioning mechanism.

8 Claims, 6 Drawing Sheets

AUXILIARY MOVING DEVICE

BACKGROUND OF THE INVENTION

1. Field of the Invention

The present invention relates to an auxiliary moving device and, more particularly, to an auxiliary moving device that includes a positioning mechanism and a rotating mechanism.

2. Description of the Prior Art

A disabled person has to be cared by a caregiver in daily life to get up, move, eat, have rehabilitation treatment or a bath, etc.

To take a bath for example, the caregiver has to assist the disabled person to move toward a bath room and, then, to make the disabled person sit on an auxiliary chair 1 as shown in FIG. 1 to have a bath. However, because the bath room is always wet and slippery, when taking a bath or doing some activities, it is dangerous, difficult, and energy consuming for the caregiver to move the disabled person by using the auxiliary chair 1, and it is also dangerous and difficult for the disabled person to rotate or move on the auxiliary chair 1.

The present invention has arisen to mitigate and/or obviate the afore-described disadvantages.

SUMMARY OF THE INVENTION

The primary objective of the present invention is to provide an auxiliary moving device can help a disabled person move in daily life.

Another objective of the present invention is to provide an auxiliary moving device having a first cushion provided to hold a second cushion by using a rotating mechanism. The second cushion rotates relative to the first cushion by ways of the rotating mechanism so that the second cushion is fixed on the first cushion by using a positioning mechanism. Thus, the disabled person sitting on the second cushion is allowed to rotate on the first cushion by the rotating mechanism, and the second cushion is located relative to the first cushion by using the positioning mechanism. Hence, the auxiliary moving device having the rotating mechanism and the positioning mechanism can help the disabled person rotate or move easily to do some activities in daily life.

To obtain the above objectives, an auxiliary moving device provided by the present invention contains:

a first cushion;

a second cushion mounted on the first cushion;

a rotating mechanism retained between the first and second cushions, with the first cushion used to hold the second cushion by using the rotating mechanism, and with the second cushion being allowed to rotate relative to the first cushion by the rotating mechanism; and a positioning mechanism connected with the first and second cushions, with the second cushion fixed on the first cushion by using the positioning mechanism.

DETAILED DESCRIPTION OF THE PREFERRED EMBODIMENTS

The present invention will be clearer from the following description when viewed together with the accompanying drawings, which show, for purpose of illustration only, the preferred embodiments in accordance with the present invention.

Figure 1:
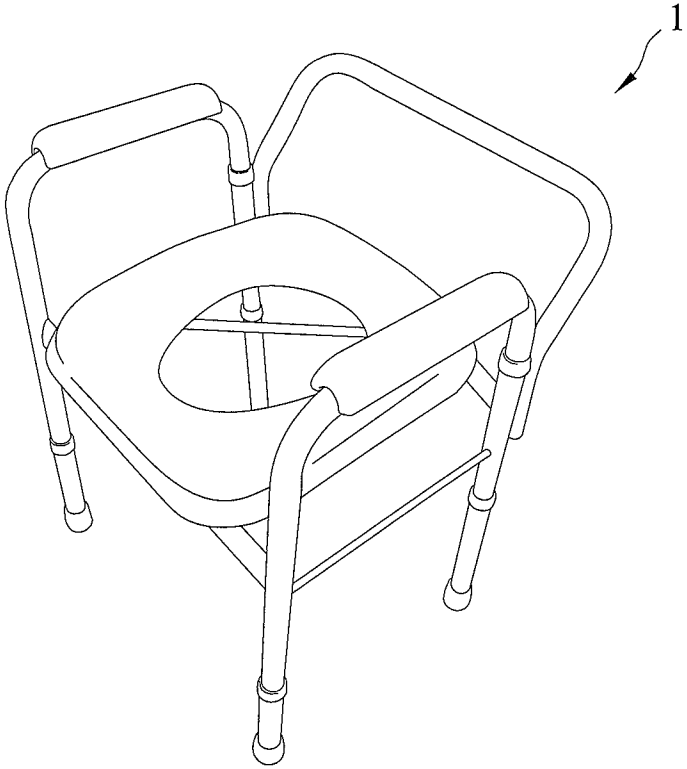
FIG. 1 PRIOR ART
FIG. 1 is a perspective view of a conventional auxiliary chair.
Figure 2A:
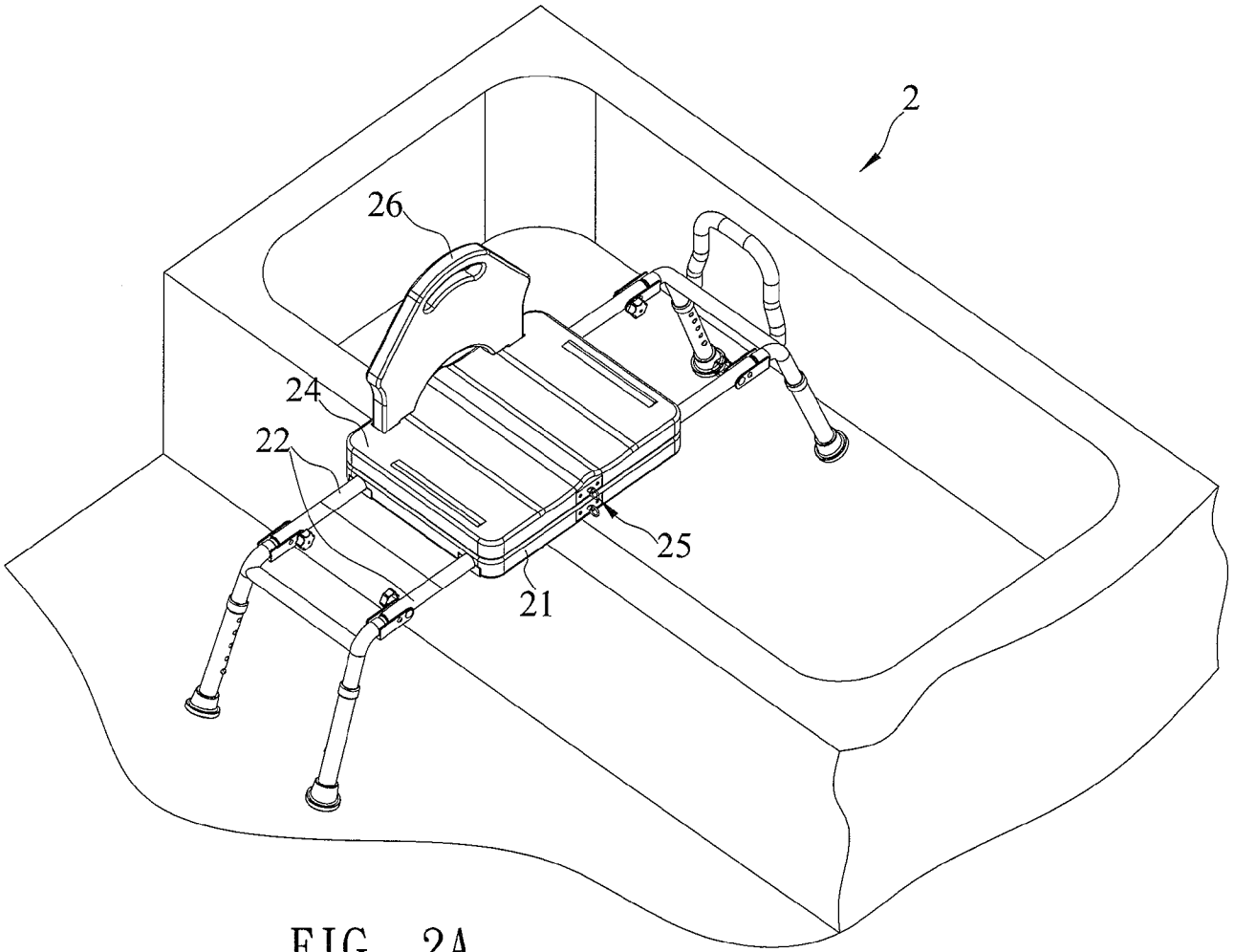
FIG. 2A is a perspective view showing the operation of an auxiliary moving device according to a preferred embodiment of the present invention.
Figure 2B:
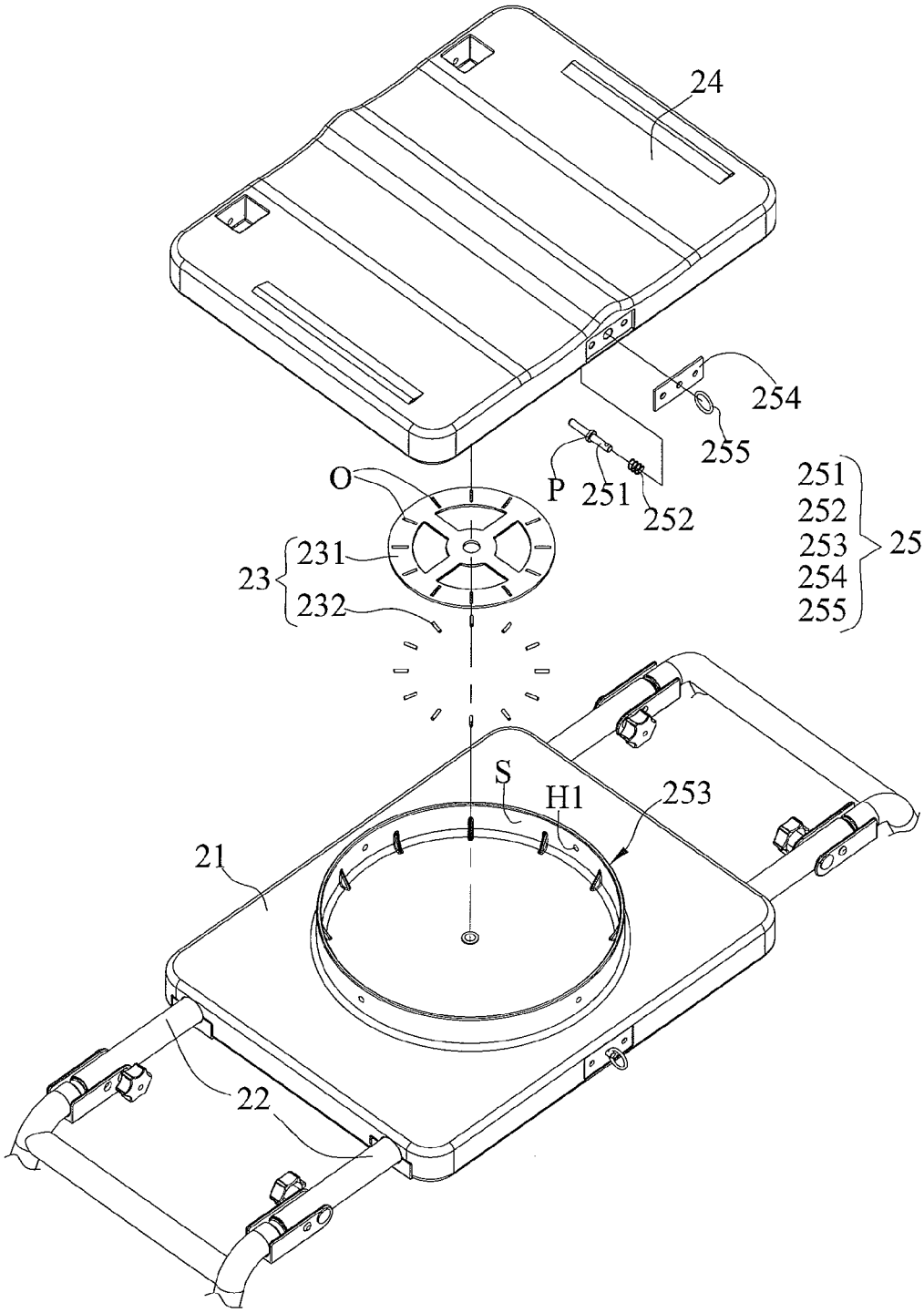
FIG. 2B is a perspective view showing the exploded components of the auxiliary moving device according to the preferred embodiment of the present invention.

With reference to FIGS. 2A and 2B, an auxiliary moving device 2 in accordance with a preferred embodiment of the present invention is used to help a disabled person move in daily life.

The auxiliary moving device 2 includes a first cushion 21, two support members 22, a rotating mechanism 23, a second cushion 24, and a positioning mechanism 25.

The support members 22 are disposed on two sides of the first cushion 21 respectively.

The second cushion 24 is mounted on the first cushion 21, and the rotating mechanism 23 is retained between the first and second cushions 21, 24. The first cushion 21 is used to hold the second cushion 24 by using the rotating mechanism 23, and the second cushion 24 rotates relative to the first cushion 21 by the rotating mechanism 23. Furthermore, the first cushion 21 is capable of moving on the support members 22 so that the second cushion 24 moves on the support members 22 by using the first cushion 21.

The rotating mechanism 23 includes a rotary disc 231 and a plurality of rolling shafts 232. The rotary disc 231 includes a number of grooves O arranged thereon evenly. In this embodiment, the rotary disc 231 includes twelve grooves O arranged thereon, and the rotating mechanism 23 includes twelve rolling shafts 232 located at the grooves O thereof individually. Of course, the numbers of the rolling shafts 232 and the grooves O are provided based on different requirements without being limited in this embodiment of the present invention.

Figure 2C:
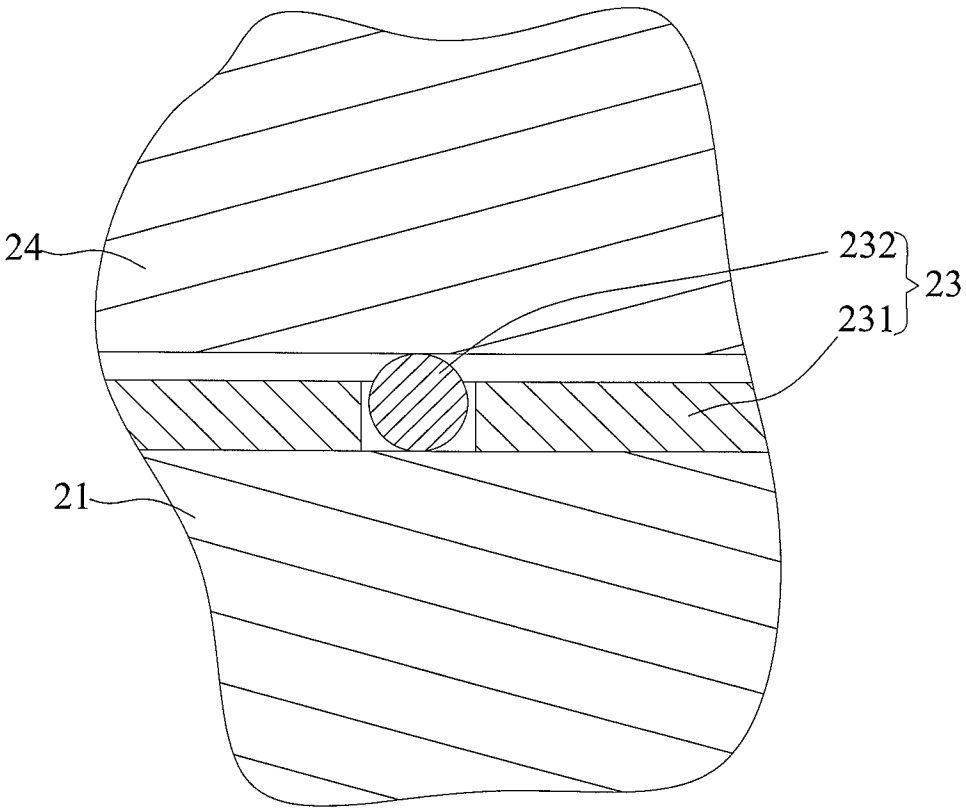
FIG. 2C is a cross sectional view of a first cushion, a rotating mechanism, and a second cushion of the auxiliary moving device according to the preferred embodiment of the present invention.

In operation of the rotating mechanism 23 as shown in FIG. 2C, when caregivers force the second cushion 24 to rotate the disabled person sitting on the second cushions 24 and since the second cushion 24 is located at the rolling shafts 232, the rolling shafts 232 in the grooves O of the rotary disc 231 roll in the grooves O as well. In other words, the rolling shafts 232 of the rotating mechanism 23 and the rotary disc 231 rotate the second cushion 24 on the first cushion 21 smoothly without forcing greatly.

Figure 2D:
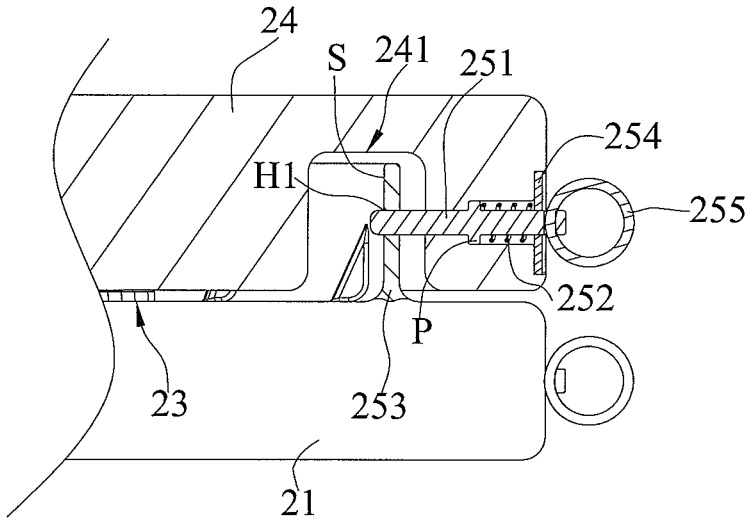
FIG. 2D is a cross sectional view showing the operation of a positioning mechanism of the auxiliary moving device according to the preferred embodiment of the present invention.

Referring further to FIGS. 2B and 2D, the positioning mechanism 25 of the auxiliary moving device 2 is connected with the first and second cushions 21, 24, and the second cushion 24 is fixed on the first cushion 21 by using the positioning mechanism 25. In other words, the positioning mechanism 25 is used to position the second cushion 24 on the first cushion 21. The positioning mechanism 25 includes a post 251, a spring 252, and a circular element 253. The post 251 is inserted through the spring 252, and the circular element 253 is coupled with the first cushion 21. It is to be noted that the rotary disc 231 is fixed on an inner side of the circular element 253.

The circular element 253 includes a side wall S, and the second cushion 24 includes an annular recess 241. The side wall S matches with the annular recess 241. In other words, the side wall S of the circular element 253 extends out of the first cushion 21 and is located at the annular recess 241 of the second cushion 24. The second cushion 24 rotates relative to the first cushion 21, and the side wall S of the circular element 253 rotates in the annular recess 241 of the second cushion 24. The circular element 253 is integrally formed with the first cushion 21 or connected with the first cushion 21 by a locking method or other methods (such as welding). In this embodiment, the circular element 253 is integrally formed with the first cushion 21.

The side wall S of the circular element 253 includes a number of holes H1, and the holes H1 are arranged on the side wall S of the circular element 253 evenly. The post 251 matches with the holes H1, In other words, a diameter of the hole H1 is larger than that of the post 251 so that the post 251 is inserted into the hole H1 to be fixed.

The positioning mechanism 25 further includes a stopping piece 254 and a pull ring 255. The post 251 includes a projection P. The spring 252 is defined between the stopping piece 254 and the projection P, and the pull ring 255 is connected with the post 251.

Figure 2E:
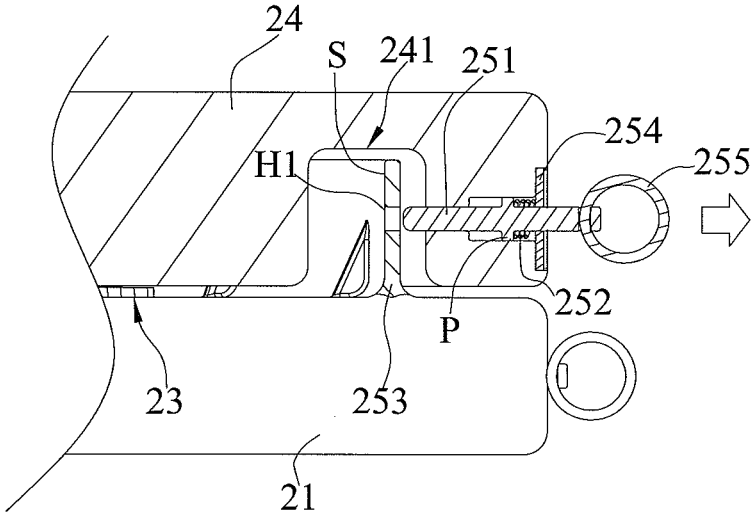
FIG. 2E is another cross sectional view showing the operation of the positioning mechanism of the auxiliary moving device according to the preferred embodiment of the present invention.

FIGS. 2D and 2E show the operation of the positioning mechanism 25.

As shown in FIG. 2E, when the caregiver pulls the pull ring 255 outward, the projection P of the post 251 moves close to the stopping piece 254 so that the spring 252 deforms and the post 251 connected with the pull ring 255 leaves the hole H1. In the meantime, the caregiver forces the second cushion 24 by using the rotating mechanism 23 so that the second cushion 24 rotates relative to the first cushion 21, and the circular element 253 rotates along the annular recess 241.

With reference to FIG. 2D, when the post 251 is desired to be placed in one of the holes H1 again, the caregiver does not force the post 251 so that the post 251 is pressed by the spring 252 to insert into the hole H1, such that the second cushion 24 is positioned on the first cushion 21 by the post 251 of the positioning mechanism 25 and the hole H1. Therefore, the second cushion 24 is fixed on the first cushion 21 without moving by using the positioning mechanism 25.

Figure 2F:
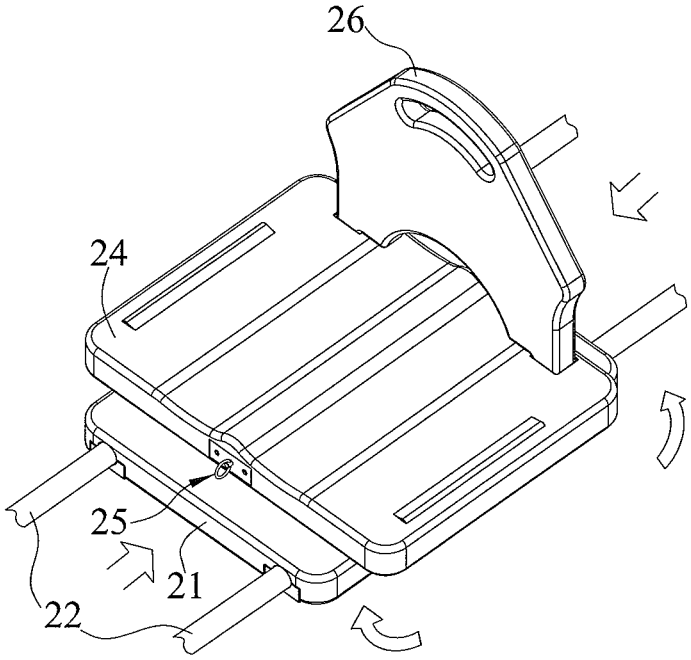
FIG. 2F is a perspective view showing the second cushion rotating relative to the first cushion according to the preferred embodiment of the present invention.

As shown in FIG. 2F, the second cushion 24 rotates 90 degrees clockwise relative to the first cushion 21, but it also allows rotating other degrees relative to the first cushion 21.

However, the second cushion 24 is not limited to rotate clockwise relative to the first cushion 21, e.g., the second cushion 24 is also allowed to rotate anticlockwise relative to the first cushion 21.

In this embodiment, the second cushion 24 is capable of rotating toward any angle relative to the first cushion 21. However, since the side wall S of the circular element 253 includes one hole H1 disposed at every 90-degree position thereof (e.g., the side wall S includes four holes H1 formed on the 90-degree positions thereof individually), the second cushion 24 rotates at 90, 180, 270 or 360 degrees relative to the first cushion 21. Besides, the side wall S of the circular element 253 is provided with different number of holes H1 at different angles based on requirement so that the second cushion 24 is in a fixed angle or the other angle (such as 60 degrees) of the first cushion 21.

The auxiliary moving device 2 further comprises a chair back 26 secured on one side of the second cushion 24 so that the disabled person sits on the auxiliary moving device 2 to move comfortably and safely.

Thereby, the first cushion is provided to hold the second cushion by using the rotating mechanism, and the second cushion rotates relative to the first cushion by ways of the rotating mechanism. Thus, the second cushion is fixed on the first cushion by using the positioning mechanism, such that the disabled person sitting on the second cushion is allowed to rotate on the first cushion by the rotating mechanism, and the second cushion is located at the first cushion by using the positioning mechanism. Hence, the auxiliary moving device having the rotating mechanism and the positioning mechanism can help the disabled person rotate or move easily to do some activities in daily life.

While various embodiments in accordance with the present invention have been shown and described, it is clear to those skilled in the art that further embodiments may be made without departing from the scope of the present invention.

What is claimed is:

1. An auxiliary moving device comprising:

a first cushion having a top surface;

a second cushion mounted on the first cushion, with the second cushion including a bottom surface terminating in an outer periphery;

a rotating mechanism retained between the first and second cushions, with the first cushion holding the second cushion by using the rotating mechanism, with the second cushion rotating relative to the first cushion about an axis by ways of the rotating mechanism; and a positioning mechanism connected with the first and second cushions, with the second cushion fixed on the first cushion by using the positioning mechanism, wherein the positioning mechanism includes a circular element coupled with the first cushion and extending outward of the top surface, wherein the circular element includes a side wall concentric to the axis, wherein the second cushion includes an annular recess having U-shaped cross sections along the axis and extending inwardly from the bottom surface concentric to the axis and spaced inwardly from the outer periphery, wherein the side wall matches with and is located within the annular recess, wherein the positioning mechanism includes a post and a spring, wherein the post is inserted through the spring and is slidably mounted in the second cushion.

2. The auxiliary moving device as claimed in claim 1, wherein the side wall of the circular element includes a number of holes, and wherein the post matches with one of the number of holes.

3. The auxiliary moving device as claimed in claim 2, wherein the number of holes are arranged on the side wall of the circular element evenly.

4. The auxiliary moving device as claimed in claim 2, wherein the positioning mechanism further includes a stopping piece fixed to the outer periphery of the second cushion, with the post extending through the stopping piece, wherein the post includes a projection, and wherein the spring is defined between the stopping piece and the projection.

5. The auxiliary moving device as claimed in claim 2, wherein the post leaves the one of the number of holes, the second cushion rotates relative to the first cushion by using the rotating mechanism.

6. The auxiliary moving device as claimed in claim 1, wherein the rotating mechanism includes a rotary disc and a plurality of rolling shafts, wherein the rotary disc includes a number of grooves arranged thereon evenly, and wherein the rolling shafts are located at the grooves of the rotary disc respectively.

7. The auxiliary moving device as claimed in claim 6, wherein when the second cushion rotates relative to the first cushion, the rolling shafts roll in the grooves individually.

8. The auxiliary moving device as claimed in claim 3, wherein the second cushion rotates at 90, 180, 270 or 360 degrees relative to the first cushion.

* * * * *